US011746069B2

(12) United States Patent
Stephens et al.

(10) Patent No.: US 11,746,069 B2
(45) Date of Patent: Sep. 5, 2023

(54) PBX COMPOSITION

(71) Applicant: BAE SYSTEMS PLC, London (GB)

(72) Inventors: Rebecca Elizabeth Stephens, Usk Monmouthshire (GB); Richard Stephen Arthur, Porthsmouth (GB); Wayne Cord Hayes, Reading (GB); Michael Edward Budd, Reading (GB)

(73) Assignee: BAE SYSTEMS PLC, London (GB)

( * ) Notice: Subject to any disclaimer, the term of this patent is extended or adjusted under 35 U.S.C. 154(b) by 452 days.

(21) Appl. No.: 17/151,557

(22) Filed: Jan. 18, 2021

(65) Prior Publication Data

US 2021/0300838 A1 Sep. 30, 2021

Related U.S. Application Data

(62) Division of application No. 15/746,980, filed as application No. PCT/GB2016/052028 on Jul. 6, 2016, now Pat. No. 11,186,528.

(30) Foreign Application Priority Data

Jul. 7, 2015 (EP) ..... 15275169
Jul. 7, 2015 (GB) ..... 1511869
Jan. 26, 2016 (GB) ..... 1601433

(51) Int. Cl.
*C06B 45/10* (2006.01)
*C06B 21/00* (2006.01)

(52) U.S. Cl.
CPC ..... *C06B 45/10* (2013.01); *C06B 21/0058* (2013.01)

(58) Field of Classification Search
CPC ..... C06B 45/10
See application file for complete search history.

(56) References Cited

U.S. PATENT DOCUMENTS 3,505,428 A 4/1970 Kidwell et al.
3,798,090 A 3/1974 Allabashi
(Continued)

FOREIGN PATENT DOCUMENTS

EP 0152209 A2 8/1985
EP 0780154 A1 6/1997
(Continued)

OTHER PUBLICATIONS

International Search Report and Written Opinion, International Patent Application No. PCT/GB2016/052028 (dated Sep. 27, 2016). *

(Continued)

*Primary Examiner* — Aileen B Felton
(74) *Attorney, Agent, or Firm* — Finch & Maloney, PLLC

(57) ABSTRACT

The invention relates to a cast explosive composition. There is provided a precure castable explosive composition comprising an explosive material, a polymerisable binder, said cross linking reagent comprising at least two reactive groups each of which is protected by a labile blocking group.

2 HB

20 Claims, 1 Drawing Sheet

(56) References Cited

U.S. PATENT DOCUMENTS

| | | | | |
|---|---|---|---|---|
| 3,909,497 | A | 9/1975 | Hendry et al. | |
| 4,101,501 | A | 7/1978 | Hinterwaldner | |
| 4,263,444 | A | 4/1981 | Graham et al. | |
| 4,428,983 | A | 1/1984 | Nehen et al. | |
| 4,530,990 | A * | 7/1985 | Halpaap | C08G 18/10 528/225 |
| 4,803,019 | A | 2/1989 | Graham et al. | |
| H000778 | H | 5/1990 | Carlton et al. | |
| 5,596,232 | A * | 1/1997 | Lefumeux | B01J 2/22 264/3.2 |
| 5,747,603 | A | 5/1998 | Hinshaw et al. | |
| 5,942,720 | A | 8/1999 | Doll et al. | |
| 7,887,651 | B1 | 2/2011 | Mahe | |
| 7,955,453 | B1 | 6/2011 | Kelley et al. | |
| 2004/0166077 | A1 | 8/2004 | Toumi et al. | |
| 2004/0241485 | A1 | 12/2004 | Kleban et al. | |
| 2010/0206418 | A1 | 8/2010 | Wolf et al. | |
| 2011/0168306 | A1 * | 7/2011 | Hollands | C06B 21/0058 149/19.2 |
| 2013/0196071 | A1 | 8/2013 | Yang et al. | |
| 2018/0208521 | A1 | 7/2018 | Stephens et al. | |
| 2018/0215678 | A1 | 8/2018 | Stephens et al. | |

FOREIGN PATENT DOCUMENTS

| | | | |
|---|---|---|---|
| FR | 2231637 | A1 | 12/1974 |
| GB | 1427697 | | 3/1976 |
| JP | 2003119309 | A | 4/2003 |
| JP | 2005213379 | A | 8/2005 |
| WO | 9112883 | | 9/1991 |
| WO | 0013504 | A1 | 3/2000 |
| WO | 9015694 | | 3/2000 |
| WO | 2011126702 | A2 | 10/2011 |
| WO | PCT/GB2016/052028 | | 7/2016 |
| WO | 2017/006110 | A1 | 1/2017 |
| WO | 2017006109 | A1 | 1/2017 |

OTHER PUBLICATIONS

International Preliminary Report on Patentability, International Patent Application No. PCT/GB2016/052028 (dated Jan. 9, 2018). *
GB Intellectual Property Office Search Report under Section 17(5), GB Patent Application No. 1511869.8 (dated Jan. 6, 2016). *
GB Intellectual Property Office Search Report under Section 17(5), GB Patent Application No. 1601433.4 (dated Aug. 17, 2016). *
Extended European Search Report, European Patent Application No. 15275169.9 (dated Jan. 25, 2016). *
Wicks, et al., "Blocked isocyanates III: Part A. Mechanisms and chemistry," Progress in Organic Coatings 36 (Elsevier 1999). *
Wicks, Zeno W., Jr., "Blocked Isocyantes," Elsevier Sequoia S.A., Lausanne, Progress in Organic Coatings 3 (1975). *
International Preliminary Report on Patentability, International Patent Application No. PCT/GB2016/052028 (dated Jan. 18, 2018). *
Budd, Michael E., "Microencapsulation Approach for use in Delayed Quick-Cure Munitions," University of Reading, MSc in Chemical Research (2012). *
Delebecq, et al., "On the Versatility of Urethane/Urea Bonds: Reversibility, Blocked Isocyanate, and Non-isocyanate Polyurethane," Chemical Reviews, ACS Publications (American Chemical Society 2012). *
Extended European Search Report, European Patent Application No. 15275168.1 (dated May 17, 2016). *
GB Intellectual Property Office Search Report under Section 17(5), GB Patent Application No. 1511867.2 (dated Jan. 6, 2016). *
GB Intellectual Property Office Search Report under Section 17(5), GB Patent Application No. 1601434.2 (dated Aug. 17, 2016). *
International Preliminary Report on Patentability, International Patent Application No. PCT/GB2016/052029 (dated Jan. 18, 2018). *
International Search Report and Written Opinion, International Patent Application No. PCT/GB2016/052029 (dated Nov. 8, 2016).*
Partial European Search Report, European Patent Application No. 15275168.1 (dated Jan. 29, 2016). *
U.S. Appl. No. 15/746,980, filed Jan. 23, 2018, Pending.

* cited by examiner

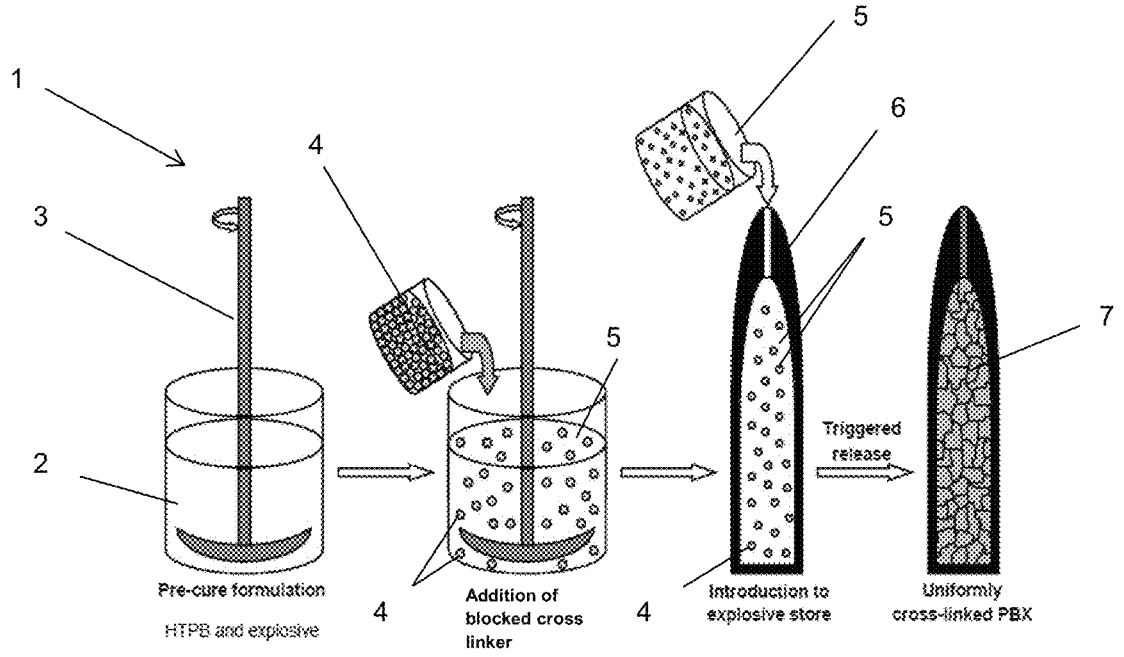
1
2
3
4
5
6
7
Pre-cure formulation
HTPB and explosive
Addition of blocked cross linker
Introduction to explosive store
Triggered release
Uniformly cross-linked PBX

PBX COMPOSITION

This invention relates to polymer bonded explosive compositions, their preparation and use. In particular, the invention relates to polymer-bonded explosive compositions for munitions.

Explosive compositions are generally shaped, the shape required depending upon the purpose intended. Shaping can be by casting, pressing, extruding or moulding; casting and pressing being the most common shaping techniques. However, it is generally desirable to cast explosives compositions as casting offers greater design flexibility than pressing.

Polymer-bonded explosives (also known as plastic-bonded explosives and PBX) are typically explosive powders bound into a polymer matrix. The presence of the matrix modifies the physical and chemical properties of the explosive and often facilitates the casting and curing of high melting point explosives. Such explosives could otherwise only be cast using melt-casting techniques. Melt casting techniques can require high processing temperatures as they generally include a meltable binder. The higher the melting point of this binder, the greater the potential hazard. In addition, the matrix can be used to prepare polymer-bonded explosives which are less sensitive to friction, impact and heat; for instance, an elastomeric matrix could provide these properties.

The matrix also facilitates the fabrication of explosive charges which are less vulnerable in terms of their response to impact, shock, thermal and other hazardous stimuli. Alternatively, a rigid polymer matrix could allow the resulting polymer-bonded explosive to be shaped by machining, for instance using a lathe, allowing the production of explosive materials with complex configurations where necessary.

Conventional casting techniques require the polymerisation step to have commenced during the fill stage which often results in a solidified composition which retains air bubbles introduced during mixing of the material, non-homogenous crosslinking, and in certain cases solidification of the "pot" of explosive before all munitions or moulds have been filled. The non-homogenous cross linking can reduce the performance of the composition as less explosive is present per unit volume. In addition, these defects may affect the shock sensitivity of the composition, making the composition less stable to impact or initiation from a shock wave.

The invention seeks to provide a cast explosive composition in which the stability of the composition is improved. Such a composition would not only offer improved stability, but also a reduced sensitivity to factors such as friction, impact and heat. Thus, the risk of inadvertent initiation of the explosive is diminished.

According to a first aspect of the invention there is provided a precure castable explosive composition comprising an explosive material, a polymerisable binder, a cross linking reagent which comprises at least two reactive groups each of which is protected by a labile blocking group.

Current processes used in the production of composite rubber materials involve mixing a hydroxy-terminated aliphatic polymer with a cross linking reagent. Upon addition, an immediate polymerisation reaction occurs, leading to the formation of a non-homogeneous cross linked rubber matrix. Formation of a non-homogenous matrix leads to material being rejected or the mixture fully polymerising before all munitions or moulds have been filled. This leads to the rejected material requiring disposal, a process that has both cost and hazard associated.

The use of a labile blocking group to protect the reactive groups of the cross linking reagent allows uniform distribution of the cross linking reagent within the precure composition, thereby allowing control of when the curing reaction may be initiated. Upon application of an external stimulus, the blocking group may be removed such that the reactive groups may be free, so as to allow the cross linking reaction to commence with the polymerisable binder, and permit the formation of a uniform PBX polymeric matrix, when desired.

The labile blocking group may on each of the at least two reactive groups on the cross linking reagent, may be the same group, or independently selected. The labile blocking groups may be independently selected so as to be removed at different deblocking temperature, or in response to different external stimuli.

The enhanced control of the start of the cross linking reactions allows the recovery of the precure composition in the event of process equipment failure. In a conventional cure process many tonnes of material would end up solidifying/curing in the reaction vessel, as one the reaction has started it cannot be readily stopped. Further, the delay of the cure reaction allows product quality to be confirmed, before the reaction is allowed to commence, thereby a poor quality composition, may be prevented from being filled into moulds or munitions. The use of labile blocking groups on the reactive groups of the cross linking reagent may reduce the exposure to operators of hazardous cross linking reagents.

In a further arrangement the polymerisable binder may be partially polymerised with the cross linking reagent, such that at least one of the at least two reactive groups on the cross linking reagent has formed a bond with the polymerisable binder, and at least one of the at least two reactive groups may protected by a labile blocking group, such that on removal of the remaining labile blocking group(s) substantially complete polymerisation with the polymerisable binder may occur.

In a preferred arrangement the polymerisable binder and cross linking reagent are partially reacted together to provide a partially polymerised binder-cross linking reagent, wherein at least one of the at least two reactive groups of the cross linking reagent is protected by a labile blocking group.

Where the cross linking reagent has low or poor solubility in the polymerisable binder or explosive material, the formation of a partially polymerised polymerisable binder/cross linking reagent may provide a means of increasing homogeneity of the binder in the explosive composition.

The partially polymerised polymerisable binder/cross linking reagent may be extracted and purified, to provide a reduced mass of removed labile protecting group in the final cured PBX.

The explosive component of the polymer-bonded explosive may, in certain embodiments, comprise one or more heteroalicyclic nitramine compounds. Nitramine compounds are those containing at least one N—$NO_2$ group. Heteroalicyclic nitramines bear a ring containing N—$NO_2$ groups. Such ring or rings may contain for example from two to ten carbon atoms and from two to ten ring nitrogen atoms. Examples of preferred heteroalicyclic nitramines are RDX (cyclo-1,2,3-trimethylene-2,4,6-trinitramine, Hexogen), HMX (cyclo-1,3,5,7-tetramethylene-2,4,6,8-tetranitramine, Octogen), and mixtures thereof. The explosive component may additionally or alternatively be selected from TATND (tetranitro-tetraminodecalin), HNS (hexanitrostilbene), TATB (triaminotrinitrobenzene), NTO (3-nitro-1,2,4-triazol-5-one), HNIW (2,4,6,8,10,12-hexanitrohexaazaisowurtzitane), GUDN (guanyldylurea dinitride), FOX-7 (1,1-diamino-2,2-dinitroethene), and combinations thereof.

Other highly energetic materials may be used in place of or in addition to the compounds specified above. Examples of other suitable known highly energetic materials include picrite (nitroguanidine), aromatic nitramines such as tetryl, ethylene dinitramine, and nitrate esters such as nitroglycerine (glycerol trinitrate), butane triol trinitrate or pentaerythritol tetranitrate, DNAN (dinitroanisole), trinitrotoluene (TNT), inorganic oxidisers such as ammonium salts, for instance, ammonium nitrate, ammonium dinitramide (ADN) or ammonium perchlorate, and energetic alkali metal and alkaline earth metal salts.

Polymer-bonded explosives include a polymeric binder which forms a matrix bonding explosive particles within. The polymerisable binder thus may be selected from a wide range of polymers, depending upon the application in which the explosive will be used. However, in general at least a portion of the polymerisable binder will be selected, when cross linked to form polyurethanes, cellulosic materials such as cellulose acetate, polyesters, polybutadienes, polyethylenes, polyisobutylenes, PVA, chlorinated rubber, epoxy resins, two-pack polyurethane systems, alkyd/melanine, vinyl resins, alkyds, thermoplastic elastomers such as butadiene-styrene block copolymers, and blends, copolymers and/or combinations thereof.

Energetic polymers may also be used either alone or in combination, these include polyNIMMO (poly(3-nitratomethyl-3-methyloxetane), polyGLYN (poly glycidyl nitrate) and GAP (glycidyl azide polymer). It is preferred that the polymerisable binder component be entirely selected from the list of polymerisable binders and/or energetic binders above either alone or in combination.

Polyurethanes are highly preferred polymerisable binders for PBX formation. In some embodiments the polymerisable binder will comprise at least partly polyurethane, often the binder will comprise 50-100 wt % polyurethane, in some instances, 80-100 wt %.

The cross linking reagents may be selected from a variety of commonly known, cross linking reagents, the selection of which depends on the functionality of the polymerisable binders.

The highly preferred polyurethanes may typically be prepared by reacting polyol-terminated monomers or polymers with polyisocyanates. In a preferred arrangement a monomer or polymer diol may be cross linked with a cross linking reagent such as a diisocyanate.

The diisocyanate may be such as, for example, MDI (methylene diphenyl diisocyanate) and TDI (toluene diisocyanate) and IPDI (isophorone diisocyanate). IPDI is generally preferred as it is a liquid and hence easy to dispense; it is relatively slow to react, providing a long pot-life and slower temperature changes during reaction; and it has a relatively low toxicity compared to most other isocyanates. It is also preferred that, where the polymerisable binder comprises polyurethane, the polyurethane polymerisable binder includes a hydroxyterminated polybutadiene.

The labile blocking group may be any reversible blocking group that may be furnished on the at least two reactive groups on the cross linking reagent, but which can be removed at a selected time by a stimulus, preferably an external stimulus.

The labile blocking group may be removed by a stimulus, such as, for example one or more of, heat, pressure, ultrasound, EM radiation, catalyst, or a shear force.

In a preferred arrangement the labile blocking group is a thermally labile blocking group, one that ruptures when subjected to elevated temperatures.

The blocking group may comprise at least one nitro group, preferably at least two nitro groups or at least one sterically hindered branched chain hydrocarbyl group.

The use of nitro, dinitro or trinitro groups on the aryl rings provides increased exothermic energy of the blocking group, and hence increased energy to the explosive composition.

In a highly preferred arrangement the cross linking reagent is a diisocyanate group, with two blocking groups B, one on each isocyanate reactive group.

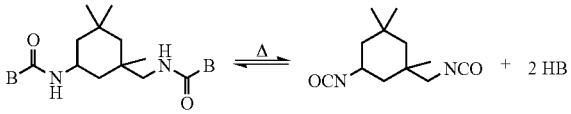

The labile blocking group B may comprise at least one nitro group, preferably at least two nitro groups or at least one sterically hindered branched chain hydrocarbyl group.

The use of nitro, dinitro or trinitro groups, such as for example on an aromatic ring, such as for example an aryl, phenyl or phenolic rings provides increased exothermic energy of the blocking group B, and hence increased energy to the explosive composition.

It has been found that for labile blocking group B, an increase in steric hindrance of the labile blocking group B, reduces the deblocking temperature, ie the reverse reaction to the free isocyanate.

In a highly preferred arrangement the diisocyanate blocking group B is selected from B is I. $NHR^2R^3$, wherein $R^2$ and $R^3$ are alkyl, alkenyl, branched-chain alkyl, $C(O)R^{12}$, aryl, phenyl, or together form a heterocycle.

$R^{12}$ is alkyl, alkenyl, branched chain alkyl aryl, phenyl, or $R^2$ and $R^3$ together form a lactam.

II. $OR^{15}$, $O—N=CR^9R^{10}$ wherein $R^{15}$ is aryl, phenyl, benzyl, provided that there are at least two nitro group on the ring;

wherein $R^9$ and $R^{10}$ are independently selected from alkyl, alkenyl, branched chain alkyl, aryl, phenyl, provided that at least one of $R^9$ or $R^{10}$ is a branched chain alkyl or aryl, or phenyl.

For PBX formulations it has been found that blocked diisocyanates may be selected to provide de-blocking temperatures in a range that occurs below the temperature of initiation of high explosive materials and above the temperatures that are generated during the mixing of the precure reagents. Thereby, there is a specific stimulus of heat which may be applied to the precure to cause the rupture of the microcapsule walls.

| Blocking Group | Deblocking Temperature Range (° C.) |
|---|---|
| 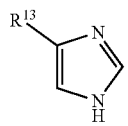 Aromatic heterocycles | 110-160 |

-continued

| Blocking Group | Deblocking Temperature Range (° C.) |
|---|---|
| 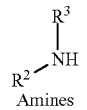 Amines | 40-130 |
| 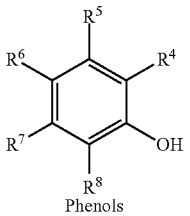 Phenols | 75-180 |
| 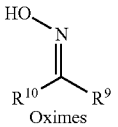 Oximes | 100-140 |
| 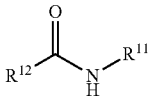 Amides | 100-157 |

In a preferred arrangement $R^4$-$R^8$ may be selected from halo, nitro, lower chain $C_{1-6}$ alkyl, In a preferred arrangement the substituted phenol comprises at least two nitro groups.

$R^2$, $R^3$, $R^9$, and $R^{10}$ may be selected from, nitro, aryl, phenyl, lower chain $C_{1-6}$ alkyl, branched chain $C_{1-8}$ alkyl, preferably isopropyl or tert-butyl.

It has been found that for blocking groups B an increase in steric hindrance of, $R^2$, $R^3$, $R^9$, and $R^{10}$ reduces the deblocking temperature, ie the reverse reaction to the free isocyanate.

In a highly preferred arrangement the thermal release of the blocking group may be in the range of from 50° C. to 150° C., more preferably in the range of from 80° C. to 120° C., such that the un-blocking occurs above current processing temperatures and well below the ignition temperature of the explosive.

According to a further aspect of the invention there is provided a batch process for filling a munition with a cross linked polymer bonded explosive composition comprising the steps of:

i) forming an admixture of precure castable explosive composition, comprising an explosive material, a polymerisable binder, and a cross linking reagent which comprises at least two reactive groups each of which is protected by a labile blocking group, ii) filling the munition, iii) causing the removal of the blocking group to furnish said cross linking reagent; optionally iv) comprising the step of causing the cure of said polymerisable binder to form a polymer bonded cast explosive composition.

Further reagents or further stimuli may be added to the composition to cause the curing reaction to commence, after the cross linking reagent has been de-blocked. In a highly preferred arrangement, the curing reaction will commence directly as a result of causing the removal of the blocking group to furnish said reactive group on the cross linking reagent.

The step of causing the removal of the blocking group to furnish the cross linking reagent, may be provided by applying at least one chemical stimulus and/or physical stimulus. The stimulus may be one or more of heat, pressure, ultrasound, EM radiation (e-beam, UV, IR), catalyst, shear force, preferably heat.

According to a further aspect of the invention there is provided a cured explosive product comprising a polymer bonded explosive composition and a protonated blocking group; preferably the protonated blocking group comprises at least 1 nitro group, more preferably at least 2 nitro groups.

The explosive component of the polymer-bonded explosive may be in admixture with a metal powder which may function as a fuel or which may be included to achieve a specific terminal effect. The metal powder may be selected from a wide range of metals including aluminium, magnesium, tungsten, alloys of these metals and combinations thereof. Often the fuel will be aluminium or an alloy thereof; often the fuel will be aluminium powder.

In some embodiments, the polymer-bonded explosive comprises RDX. The polymer-bonded explosive may comprise RDX as the only explosive component, or in combination with a secondary explosive component, such as HMX. Preferably, RDX comprises 50-100 wt % of the explosive component.

In many cases the polymerisable binder will be present in the range about 5-20 wt % of the polymer-bonded explosive, often about 5-15 wt %, or about 8-12 wt %. The polymer-bonded explosive may comprise about 88 wt % RDX and about 12 wt % polyurethane binder. However, the relative levels of RDX to polyurethane binder may be in the range about 75-95 wt % RDX and 5-25 wt % polyurethane binder. Polymer-bonded explosives of this composition are commercially available, for example, Rowanex 1100™.

Many defoaming agents are known and in general any defoaming agent or combination thereof which does not chemically react with the explosive may be used. However, often the defoaming agent will be a polysiloxane. In many embodiments, the polysiloxane is selected from polyalkyl siloxanes, polyalkylaryl siloxanes, polyether siloxane copolymers, and combinations thereof. It is often preferred that the polysiloxane be a polyalkylsiloxane; polydimethylsiloxane may typically be used. Alternatively, the defoaming agent may be a combination of silicone-free surface active polymers, or a combination of these with a polysiloxane. Such silicone-free polymers include alkoxylated alcohols, triisobutyl phosphate, and fumed silica. Commercially available products which may be used include, BYK 088, BYK A500, BYK 066N and BYK A535 each available from BYK Additives and Instruments, a subdivision of Altana; TEGO MR2132 available from Evonik; and BASF SD23 and SD40, both available from BASF. Of these, BYK A535 and TEGO MR2132 are often used as they are solventless products with good void reduction properties.

Often the defoaming agent is present in the range about 0.01-2 wt %, in some instances about 0.03-1.5 wt %, often about 0.05-1 wt %, in many cases about 0.25 or 0.5-1 wt %. At levels below this (i.e. below 0.01 wt %) there is often insufficient defoaming agent in the composition to significantly alter the properties of the polymer-bonded explosive, whereas above this level (i.e. above 2 wt %) the viscosity of the cast solution may be so low that the composition becomes non-homogenous as a result of sedimentation and segregation processes occurring within the mixture.

The explosive composition may include a solvent, any solvent in which at least one of the components is soluble and which does not adversely affect the safety of the final product may be used, as would be understood by the person skilled in the art. However, it is preferred, for the reasons described above, that in some embodiments that solvent be absent.

Where present, the solvent may be added as a carrier for the components of the composition. The solvent will typically be removed from the explosive composition during the casting process, however some solvent residue may remain due to imperfections in the processing techniques or where it becomes uneconomical to remove the remaining solvent from the composition. Often the solvent will be selected from diisobutylketone, polypropylene glycol, isoparaffins, propylene glycol, cyclohexanone, butyl glycol, ethylhexanol, white spirit, isoparaffins, xylene, methoxypropylacetate, butylacetate, naphthenes, glycolic acid butyl ester, alkyl benzenes and combinations thereof. In some instances, the solvent is selected from diisobutylketone, polypropylene glycol, isoparaffins, propylene glycol, isoparaffins, and combinations thereof.

The composition may also contain minor amounts of other additives commonly used in explosives compositions. Examples of these include microcrystalline wax, energetic plasticisers, non-energetic plasticisers, anti-oxidants, catalysts, curing agents, metallic fuels, coupling agents, surfactants, dyes and combinations thereof. Energetic plasticisers may be selected from eutectic mixtures of alkylnitrobenzenes (such as dinitro- and trinitro-ethyl benzene), alkyl derivatives of linear nitramines (such as an N-alkyl nitratoethyl-nitramine, for instance butyl-NENA), and glycidyl azide polymers.

Casting the explosive composition offers a greater flexibility of process design than can be obtained with pressing techniques. This is because the casting of different shapes can be facilitated through the simple substitution of one casting mould for another. In other words, the casting process is backwards-compatible with earlier processing apparatus. Conversely, where a change of product shape is required using pressing techniques, it is typically necessary to redesign a substantial portion of the production apparatus for compatibility with the mould, or the munition to be filled, leading to time and costs penalties. Further, casting techniques are less limited by size than pressing techniques which depend upon the transmission of pressure through the moulding powder to cause compaction. This pressure falls off rapidly with distance, making homogeneous charges with large length to diameter ratios (such as many shell fillings) more difficult to manufacture.

In addition, the casting process of the invention offers a moulded product (the cast explosive compositions described) with a reliably uniform fill regardless of the shape required by the casting. This may be partly attributed to the use of a delayed curing technique, Casting can occur in situ with the housing (such as a munition) to be filled acting as the mould; or the composition can be moulded and transferred into a housing in the munition in a separate step. Often casting will occur in situ.

Further, compositions including polymer-bonded explosives and hydroxyterminated polybutadiene binders in particular, are more elastomeric when cast than when pressed. This makes them less prone to undergoing a deflagration-to-detonation transition when exposed to accidental stimuli. Instead, such systems burn without detonating, making them safer to use than pressed systems.

Additionally, the shapes that pressing processes can be reliably applied to are more limited. For instance, it is often a problem achieving a complete fill of a conical shape using pressing techniques as air is often trapped at or towards the tip of the cone. Casting processes, being intrinsically "fluid" processes, are not limited in this way.

In some instances the explosive component is desensitized with water prior to formation of the premix, a process known as wetting or phlegmatization. However, as retention of water within the precure is generally undesirable it will typically be removed from the premix prior to further processing, for instance by heating during the mixing of the explosive component and the plasticiser.

In some cases the plasticiser will be absent; however the plasticiser will typically be present in the range 0-10 wt % of the plasticiser and explosive premix, often in the range 0.01-8 wt %, on occasion 0.5-7 wt % or 4-6 wt %. The plasticiser will often be a non-energetic plasticiser, many are known in the art; however energetic plasticisers may also be used in some instances. The cast explosive composition of the invention has utility both as a main charge or a booster charge in an explosive product. Often the composition will be the main charge. The composition of the invention may be used in any "energetic" application such as, for example, uses include mortar bombs and artillery shells as discussed above. Additionally, the inventive composition may be used to prepare explosives for gun-launch applications, explosive filings for bombs and warheads, propellants, including composite propellants, base bleed compositions, gun propellants and gas generators.

Except in the examples, or where otherwise explicitly indicated, all numbers in this description indicating amounts of material or conditions of reaction, physical properties of materials and/or use are to be understood as modified by the word "about." All amounts are by weight of the final composition, unless otherwise specified. Further, the cast explosive composition may comprise, consist essentially of, or consist of any of the possible combinations of components described above and in the claims except for where otherwise specifically indicated.

The following non-limiting examples illustrate the invention.

EXAMPLES

General Synthesis of Blocked IPDI

Blocking group B and isophorone diisocyanate were dissolved in THF or $CHCl_3$ and refluxed until reaction has reached completion. The solvent was removed in vacuo to leave the blocked IPDI as a white solid. The yields are given in Table 1 below.

TABLE 1
| blocked di-isocyanates | | | |
|---|---|---|---|
| Compound | Blocking group B | Ratio of blocking group to IPDI | Yield (%) |
| 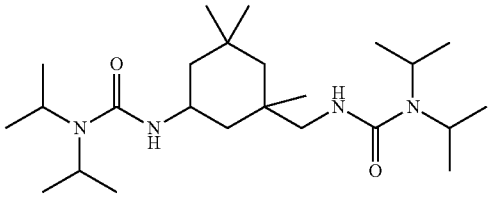 | 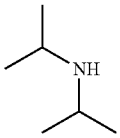 | 2.1:1 | 93 |
| 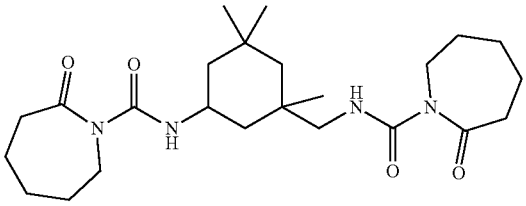 | 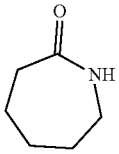 | 2.1:1 | 62 |
| 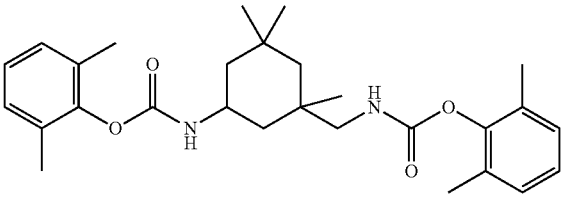 | 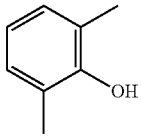 | 2:1 | 54 |
| 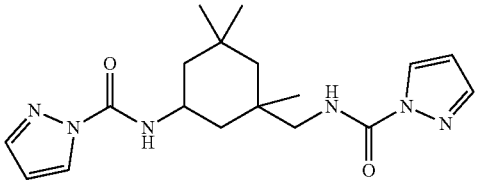 | 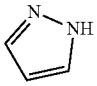 | 2:1 | 99 |
| 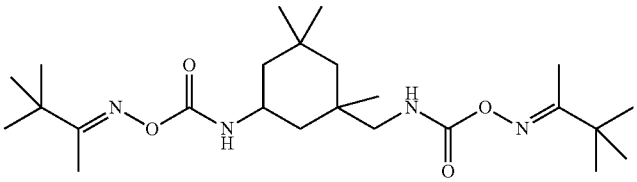 | 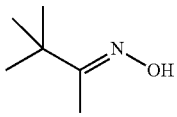 | 2:1 | 99 |
| 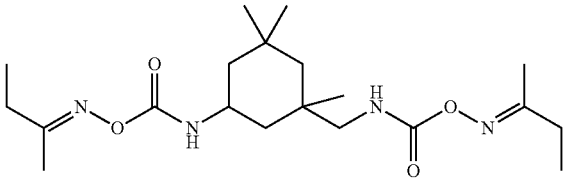 | 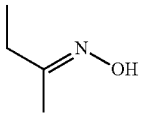 | 2:1 | 98 |
| 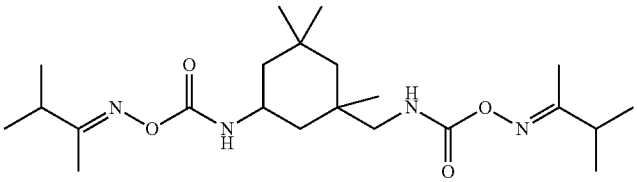 | 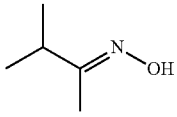 | 2:1 | 96 |

TABLE 1-continued blocked di-isocyanates

| Compound | Blocking group B | Ratio of blocking group to IPDI | Yield (%) |
|---|---|---|---|
| 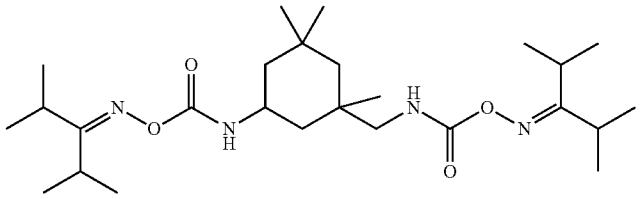 | 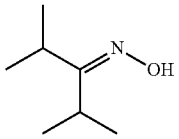 | 2:1 | 98 |
| 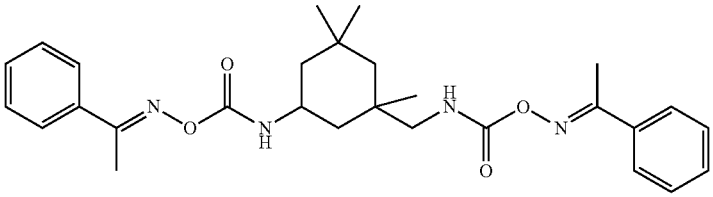 | 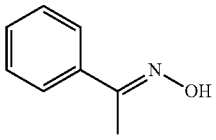 | 2:1 | 100 |
| 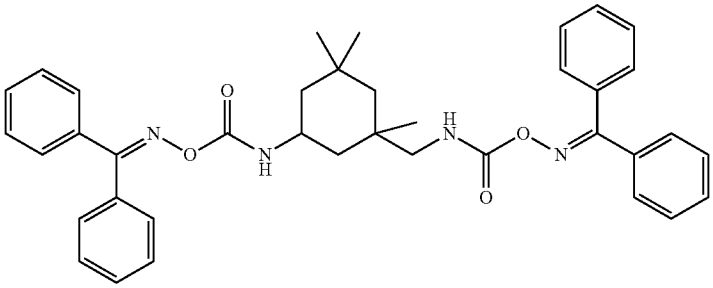 | 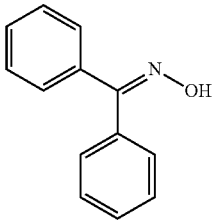 | 2:1 | 97 |

General Deblocking Method for Compounds in Table 1.

Blocked IPDI (8.68 wt %) was evenly dispersed in a composition of hydroxyl-terminated polybutadiene (91.1 wt %) and dibutyltin dilaurate (0.22 wt %) at 60° C. over a period of 2 hours. The mixture was poured into a cast and cured between 90-120° C. over a period of several days to achieve a cross linked rubber. It was found for all examples there was no reaction between the blocked isocyanate and HTPB in the presence of the catalyst, at 55° C., even when left overnight.

This indicates that the blocking group was not removed until temperatures above 90° C. were employed. Therefore general processing of the precure castable explosive composition may proceed to be mixed, even with slight heating to aid mixing, and that the deblocking only occurs when significant heat is employed to specifically activate and deblock the diisocyanate, such that the cross linking reaction may only proceed once the temperature is raised, to the deblocking temperature.

Dissociation of Blocked-IPDI

The dissociation temperature of the generated blocked isocyanates was undertaken to ascertain the conditions required in order to achieve the cure of the polymer such as, for example HTPB. Techniques such as variable temperature infra-red spectroscopy (VTIR) can be employed to observe the dissociation of thermally-labile oxime-urethanes.

The blocked isocyanates 5.1 to 5.6 were dissolved in dried tetraethylene glycol dimethyl ether in a ratio of 1:0.25 wt. %. This solution was injected into a variable temperature cell and an IR spectrum recorded at 10° C. increments. The dissociation temperature was recorded as the onset at which an absorption characteristic of the isocyanate stretching vibration ~2250 cm-1 was observed Table 2.

TABLE 2

Dissociation temperatures of blocked-isocyanates 5.1 to 5.6 measured using VTIR spectroscopy

| | Blocking group | Dissociation Temperature (° C.) |
|---|---|---|
| 5.1 | diisopropylamine | 100 |
| 5.2 | □-caprolactam | 130 |
| 5.4 | 3,3-dimethyl-2-butanone oxime | 120 |
| 5.5 | imidazole | 70 |
| 5.6 | 2,6-dimethylphenol | 150 |

A preferred dissociation temperature may be in the range of 70 to 100° C. Imidazole-blocked IPDI 5.5 began to dissociate at 70° C., well within the desired temperature range. Diisopropylamine-blocked IPDI 5.1 exhibited dissociation at 100° C. and it is expected that increasing the steric hindrance around the bond will lead to a reduction in the dissociation temperature and can be easily achieved by blocking with more sterically hindered amines. 3,3-Dimethyl-2-butanone oxime-blocked IPDI 5.4 began to dissociate at 120° C., although this is above the desired temperature.

The dissociation temperature of oxime-urethanes may also be reduced by increasing the steric hindrance around the oxime.

TABLE 3

Dissociation temperatures of IPDI blocked with a range of oximes possessing varying degrees of steric hindrance.

| | Blocking Group | Dissociation Temperature (° C.) |
|---|---|---|
| 5.12 | 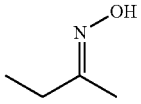 E:Z = 3:1 | 135 |
| 5.13 | 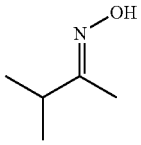 E:Z = 4:1 | 100 |
| 5.4 | 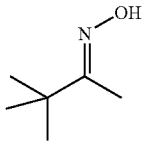 | 120 |
| 5.14 | 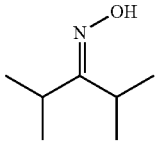 | 100 |
| 5.15 | 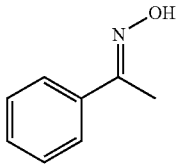 | 120 |
| 5.16 | 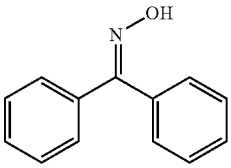 | 95 |

The dissociation temperature of the oxime-urethanes 5.12 to 5.16 was measured using VTIR spectroscopy and the results are listed in Table 3, above.

The least sterically encumbered oxime-urethane 5.12 dissociated at 135° C. It was expected the dissociation of 5.13 would occur at the next highest temperature followed by 5.4. However, the dissociation of 5.13 was observed 20° C. below that of 5.4. This result suggests that sterically encumbered Z-oximes have a greater effect on the dissociation temperature than the corresponding E-isomer. Furthermore, the dissociation of 5.14 was observed at the same temperature as 5.13. This steric effect was also observed in aromatic oximes, benzophenone-based oxime-urethane 5.16 dissociating at a lower temperature than the acetophenone analogue 5.15.

Cure of HTPB Using Blocked-IPDI

The potential of these blocked-isocyanates to cure hydroxy-functionalised polymers at elevated temperatures was investigated. The blocked isocyanates 5.1-6 (8.01 mmol) were dispersed in a mixture of HTPB (18.22 g) and DBTDL (0.044 g) using an overhead stirrer at 70° C. In order to achieve uniform curing of HTPB, complete dispersion of the blocked isocyanates within HTPB was desired and indeed 5.1 5.2 and 5.4 exhibited excellent solubility at 70° C. In contrast, imidazole-blocked IPDI 5.5 and 2,6-dimethylphenol-blocked IPDI 5.6 exhibited poor solubility in HTPB and thus efficient dispersion was not achieved.

The mixtures were heated for a period of 72 hours at 120° C. in an evacuated atmosphere. Curing of HTPB was achieved using diisopropylamine-blocked IPDI 5.1—however, as a result of the evolution of volatile diisopropylamine, bubbles were formed within the polyurethane rubber. The high dissociation temperature of caprolactam-blocked IPDI 5.2 (130° C.) prevented the cure of HTPB. The cure of HTPB was successfully achieved using oxime-urethane 5.4. The poor solubility of 5.5 in HTPB prevented the formation of a homogeneously crosslinked polyurethane, thus the formation of a uniformly crosslinked matrix was not achieved. The high temperatures required for the dissociation of 2,6-dimethylphenol-blocked IPDI 5.6 and its poor solubility in HTPB prevented the formation of a polyurethane matrix (Table 4).

TABLE 4

Solubility and curing capability of blocked isocyanates 5.1-6 in HTPB

| Blocking group | Soluble in HTPB(70° C.) | Cure of HTPB (120° C.) |
|---|---|---|
| 5.1 diisopropylamine | yes | yes |
| 5.2 caprolactam | yes | no |
| 5.4 3,3-dimethyl-2-butanone oxime | yes | yes |
| 5.5 imidazole | no | no |
| 5.6 2,6-dimethylphenol | no | no |

These results identify that oxime-urethanes possess the ideal properties required for their potential employment in explosive formulations—soluble in HTPB, low volatility of released oxime and relatively low dissociation temperature that could be decreased by modification of the steric and electronic properties of the oxime.

Electron Effects on the Dissociation of Oxime-Urethanes

A range of oxime-urethanes using acetophenone oxime analogues were generated that contain electron-withdrawing and electron donating moieties at the ortho, meta, and para-positions. The dissociation temperatures of the generated oxime-urethanes were measured using VTIR spectroscopy (Table 5).

TABLE 5

Dissociation temperatures of IPDI blocked with a range of acetophenone oxime analogues that possess electron withdrawing or electron donating groups at the ortho, meta or para positions.

| | Blocking Group | Dissociation Temperature (° C.) |
|---|---|---|
| 5.23 | 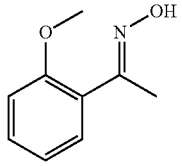 | 90 |

TABLE 5-continued

Dissociation temperatures of IPDI blocked with a range of acetophenone oxime analogues that possess electron withdrawing or electron donating groups at the ortho, meta or para positions.

| | Blocking Group | Dissociation Temperature (° C.) |
|---|---|---|
| 5.24 | 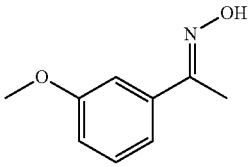 | 100 |
| 5.25 | 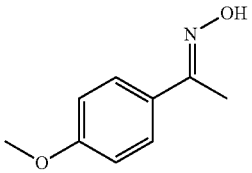 | 120 |
| 5.26 | 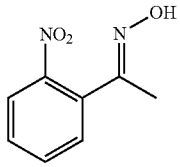 E:Z = 1:2 | 120 |
| 5.27 | 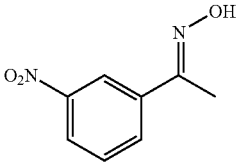 | 130 |
| 5.28 | 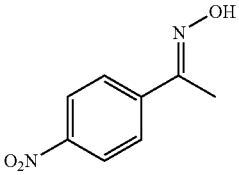 | 120 |

The dissociation temperature appeared to be significantly reduced by the presence of an electron withdrawing group at the para-position 5.23. The presence of an ortho nitro-substituent did not reduce the dissociation temperature.

Curing Studies of HTPB Using Oxime-Urethanes

The potential of the generated oxime-urethanes 5.12 to 5.28 to cure HTPB was investigated. Each oxime-urethane (8.01 mmol) was mixed with HTPB (18.22 g) and DBTDL (0.044 g) in ratios according to the Rowanex 1100 formulation using an overhead stirrer at 70° C. All aliphatic oxime-urethanes exhibited excellent solubility in HTPB at 70° C., thus complete dispersion was achieved. In contrast, all of the aromatic oxime-urethanes exhibited poor solubility at 70° C. and uniform dispersion of 5.15, 5.16 and 5.23 could only be achieved at high temperatures (>100° C.) with vigorous mixing. Uniform dispersion of all of the other aromatic oxime-urethanes was not achieved.

The mixtures were heated to 120° C. for a period of 72 hours in an evacuated atmosphere. Cured HTPB was afforded successfully using sterically encumbered aliphatic oxime-urethanes 5.13 and 5.14. The generation of a polyurethane matrix was achieved using 5.15, 5.16 and 5.23, however, the poor solubility of these oxime-urethanes led to separation from the polymer and the formation of crystallised regions was observed. The poor solubility of aromatic oximes 5.24 to 5.28 prevented the formation of a polyurethane matrix and only curing small regions of HTPB.

TABLE 5.6

Solubility and curing capability of oxime-urethanes 5.12-28 in HTPB.

| | Blocking group | Soluble in HTPB (70° C.) | Cure of HTPB (120° C.) |
|---|---|---|---|
| 5.12 | 2-Butanone oxime | yes | no |
| 5.13 | 3-Methyl-2-butanone oxime | yes | yes |
| 5.4 | 3,3-Dimethyl-2-butanone oxime | yes | yes |
| 5.14 | 2,4-Dimethyl-3-pentanone oxime | yes | yes |
| 5.15 | Acetophenone oxime | no | yes |
| 5.16 | Benzophenone oxime | no | yes |
| 5.23 | o-Methoxyacetophenone oxime | no | yes |
| 5.24 | m-Methoxyacetophenone oxime | no | no |
| 5.25 | p-Methoxyacetophenone oxime | no | no |
| 5.26 | o-Nitroacetophenone oxime | no | no |
| 5.27 | m-Nitroacetophenone oxime | no | no |
| 5.28 | p-Nitroacetophenone oxime | no | no |

Monitoring the Curing of HTPB

A variety of techniques can be employed to monitor the reaction of curing polyurethanes. These include 1H NMR spectroscopy, IR spectroscopy, differential scanning analysis (DSC), swelling behaviour and tensile testing.

As a result of the high molecular weight and restricted mobility of the polymer chains in curing HTPB, traditional methods for observing chemical reaction using 1H NMR spectroscopy is restricted. In addition, the elastomeric nature of the cured material prevented the preparation of a fine powder required for solid state NMR techniques.

In an IR spectrum, isocyanates exhibit a stretching vibration that appears as an absorption at 2250 cm-1, thus observing the appearance of this characteristic absorption upon dissociation of the blocked isocyanate followed by its disappearance as the crosslinking reaction reaches completion could be an effective method for monitoring the curing reaction. However, no absorption corresponding to the isocyanate was observed during curing, suggesting the reaction occurred immediately upon the dissociation of the blocked isocyanates.

As the curing reaction ensues, the crosslinking density in turn also increases, this may be observed by an increase in the glass transition temperature Tg as the mobility of the polymer chains decreases. However, the glass transition of the fully cured polyurethane was below the detectable limits of DSC or indeed the high crosslinking density prevented the observation of a defined transition.

Tensile testing offers a route to monitor the curing reaction, as the curing reaction ensues and the crosslinking density increases, the elastic modulus (=□stress/□strain) is expected to increase. Tensile testing of the curing mixture of HTPB and 5.4 was measured at 24, 48 and 72 hours at 120° C. In addition, tensile testing was performed on a control polyurethane generated from IPDI, HTPB and DBTDL cured for 72 hours at 60° C. An increase in the elastic modulus was observed after 48 hours and a small increase was observed after 72 hours, suggesting the majority of the curing had occurred within 48 hours at 120° C. The elastic modulus of cured control polyurethane was significantly higher than the 5.4 mixture. A plasticising effect of the released oxime may account for this change in elastic modulus.

Benzophenone Oxime-Blocked HTPB Based Prepolymer

Benzophenone oxime and IPDI were reacted in a ratio of 1:2, this ensured a mixture of IPDI, mono-blocked IPDI and di-blocked IPDI was generated. To this mixture, HTPB and DBTDL were added in order to afford an oligomeric mixture that contains benzophenone oxime-blocked HTPB based prepolymer 5.29

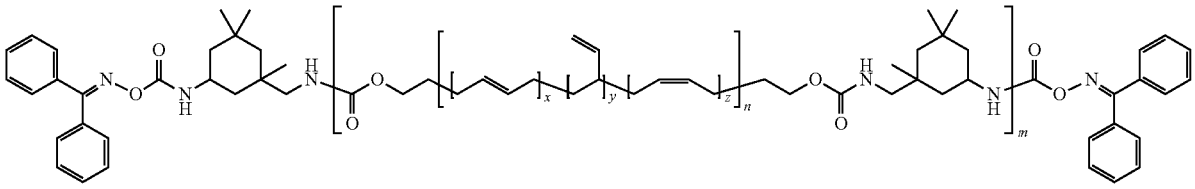

Structure of Benzophenone Oxime-Blocked HTPB Based Prepolymer 5.29.

The oligomeric mixture 5.29 was cured at 120° C. for a period of 72 hours and a uniformly crosslinked polyurethane was generated successfully. Swelling tests revealed that the complete crosslinking was achieved after 72 hours Synthesis of o-Nitroacetophenone Oxime Blocked-IPDI 5.26

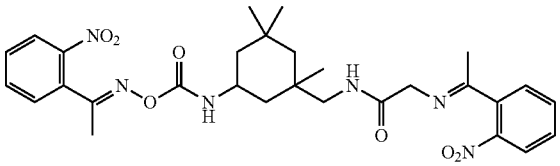

Isophorone diisocyanate (7.13 g, 32.1 mmol) and o-nitroacetophenone oxime 5.20 (11.55 g, 64.1 mmol) were dissolved in THF (100 mL) and maintained under reflux for 18 hours under an atmosphere of argon. The solvent was removed to leave a pale yellow coloured solid 5.26 (18.65 g, 100%) (m.p. 78-80° C.). 1H NMR (400 MHz, $CDCl_3$) □H (ppm): 0.94 (3H, s, CH3), 1.00 (1H, m, CH2), 1.00 (1H, m, CH2), 1.06 (1H, m, CH2), 1.08 (3H, s, CH3), 1.09 (3H, s, CH3), 1.22 (1H, m, CH2), 1.75 (1H, m, CH2), 1.79 (1H, m, CH2), 2.38 (3H, s, CH3), 3.03 (2H, m, CH2), 3.92 (1H, m, CH), 5.95 (1H, m, NH), 6.20 (1H, m, NH), 7.47-7.74 (6H, m, 6×CH), 8.01-8.22 (2H, m, 2×CH); 13C NMR (100 MHz, $CDCl_3$) □C (ppm): 17.4, 21.6, 23.1, 27.4, 31.9, 34.8, 36.5, 41.3, 45.0, 46.2, 46.9, 54.8, 124.7, 128.1, 130.1, 130.6, 131.3, 131.7, 133.6, 133.7, 134.4, 145.6, 147.7, 154.0, 155.3, 160.0; FTIR (ATR) □ (cm-1): 3411 (N—H), 2954 (C—H), 1731 (C═O), 1612 (C═N), 1525 (N—O), 1499 (C—N), 1028 (C—O), 993 (C—O), 913 (N—O); ESIMS calculated mass (C28H34O8N6Na)+605.2330 found 605.2328.

Synthesis of m-Nitroacetophenone Oxime Blocked-IPDI 5.27

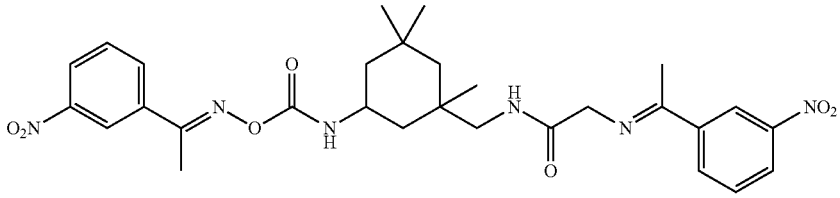

Isophorone diisocyanate (7.05 g, 31.7 mmol) and m-nitroacetophenone oxime 5.21 (11.43 g, 63.4 mmol) were dissolved in THF (100 mL) and maintained under reflux for 18 hours under an atmosphere of argon. The solvent was removed to leave a pale yellow coloured solid 5.27 (18.65 g, 100%) (m.p. 78-80° C.). 1H NMR (400 MHz, $CDCl_3$) □H (ppm): 1.00 (3H, s, CH3), 1.10 (1H, m, CH2), 1.10 (1H, m, CH2), 1.13 (3H, s, CH3), 1.15 (1H, m, CH2), 1.17 (3H, s, CH3), 1.30 (1H, m, CH2), 1.85 (1H, m, CH2), 1.89 (1H, m, CH2), 2.50 (3H, s, CH3), 3.14 (2H, m, CH2), 4.03 (1H, m, CH), 6.07 (1H, m, NH), 6.45 (1H, m, NH), 7.65 (1H, m, CH), 8.03 (1H, m, CH), 8.32 (1H, m, CH), 8.54 (1H, m, CH); 13C NMR (100 MHz, $CDCl_3$) □C (ppm): 14.5, 23.11, 27.7, 32.0, 34.7, 36.8, 41.5, 45.1, 46.0, 47.2, 54.8, 121.7, 124.9, 129.9, 132.5, 136.6, 148.4, 154.0, 155.3, 158.2; FTIR (ATR) □ (cm-1): 3408 (N—H), 2953 (C—H), 1727 (C═O), 1623 (C═N), 1528 (N—O), 1498 (C—N), 994 (C—O), 929 (N—O); ESIMS calculated mass (C28H34O8N6Na)+605.2330 found 605.2329.

Synthesis of p-Nitroacetophenone Oxime Blocked-IPDI 5.28

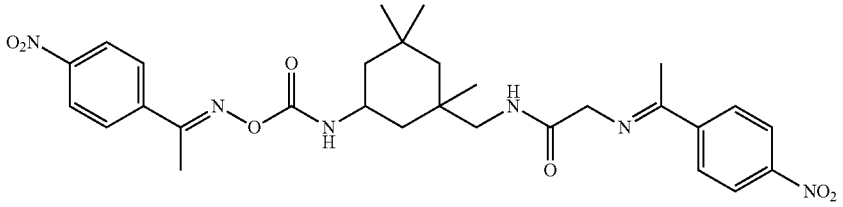

Isophorone diisocyanate (7.33 g, 32.0 mmol) and p-nitroacetophenone oxime 5.22 (11.88 g, 65.9 mmol) were dissolved in THF (100 mL) and maintained under reflux for 18 hours under an atmosphere of argon. The solvent was removed to leave a pale yellow coloured solid 5.28 (19.21 g, 99%) (m.p. 81-85° C.). 1H NMR (400 MHz, $CDCl_3$) □H (ppm): 0.99 (3H, s, CH3), 1.08 (1H, m, CH2), 1.09 (1H, m, CH2), 1.12 (3H, s, CH3), 1.14 (1H, m, CH2), 1.15 (3H, s, CH3), 1.29 (1H, m, CH2), 1.83 (1H, m, CH2), 1.90 (1H, m, CH2), 2.49 (3H, s, CH3), 3.13 (2H, m, CH2), 4.01 (1H, m, CH), 6.04 (1H, m, NH), 6.40 (1H, m, NH), 7.86 (2H, AA'XX' system, 2×CH), 8.29 (2H, AA'XX' system, 2×CH); 13C NMR (100 MHz, $CDCl_3$) □C (ppm): 14.4, 22.8, 27.6, 32.0, 35.0, 36.7, 41.6, 45.1, 45.8, 47.3, 54.8, 123.9, 127.8, 140.8, 148.9, 153.9, 155.3, 158.7; FTIR (ATR) □ (cm-1): 3405 (N—H), 2953 (C—H), 1727 (C═O), 1594 (C═N), 1516 (N—O), 1497 (C—N), 993 (C—O), 921 (N—O); ESIMS calculated mass (C28H34O8N6Na)+605.2330 found 605.2329.

Synthesis of Benzophenone-Blocked HTPB Prepolymer 5.29

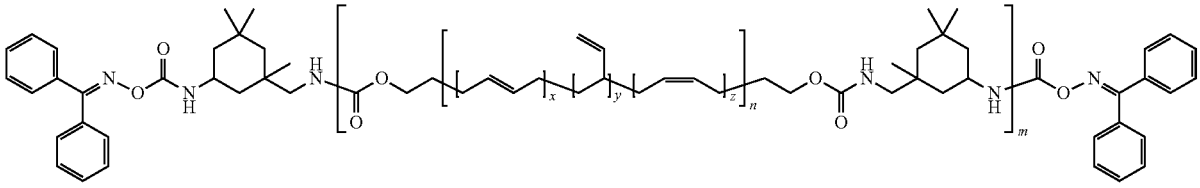

IPDI (17.8 g, 8.0 mmol) and benzophenone oxime (0.808 g, 4.1 mmol) were dissolved in THF (100 mL) and maintained under reflux for a period of 18 hours under an atmosphere of argon. The solution was added to a mixture of hydroxy-terminated polybutadiene (HTPB) (18.22 g) and DBTDL (0.044 g, 0.07 mmol) and maintained under reflux for a further period of 18 hours. The solvent was removed in vacuo to give a pale yellow coloured viscous oil 5.29 (21.03 g, 100%). FTIR (ATR) □ (cm-1): 3007 (C—H), 2915 (C H), 2844 (C—H), 1714 (C═O), 1639 (C═N), 1511 (C—N), 1216 (C—N), 965 (C—O) 911 (N—O), 754 (C═C); GPC (THF, BHT 250 ppm): Mn=12718 Da, Mw=76566 Da, Đ=6.02.

An embodiment of the invention will now be described by way of example only and with reference to the accompanying drawings of which:—

FIG. 1 shows a schematic of the fill process

Turning to FIG. 1 there is a general scheme 1, for filling a munition 6. The premix formulation 2, is a mixture of the explosive, HTBP polymerisable binder and other processing aids, and optionally a catalyst. The premix formulation 2 is agitated such as by a stirrer 3. A blocked cross linking reagent 4, (either as a solid or dissolved in a minimal aliquot of solvent), is added to the premix to form the precure formulation 5. The blocked cross linking reagent 4 may be a diisocyanate such as IPDI. The resultant precure admixture 5 is thoroughly mixed and is transferred to a munition 6 or mould (not shown) for later insertion into a munition. The munition 6 when filled with the precure 5 may then be exposed to an external stimuli, such as heat, which removes the thermally labile blocking group on the blocked cross linking reagent 4, furnishing the cross linking reagent. The cross linking reagent and HTPB polymerisable binder may then polymerise and form a polymer bonded explosive 7.

It should be appreciated that the compositions of the invention are capable of being incorporated in the form of a variety of embodiments, only a few of which have been illustrated and described above.

The invention claimed is:

1. A batch process for filling a munition with a cross linked polymer bonded explosive composition, the batch process comprising:

forming an admixture of precure castable explosive composition, comprising an explosive material, a polymerisable binder, and a cross-linking reagent comprising a first reactive group protected by a first labile blocking group and a second reactive group protected by a second labile blocking group;

filling the munition with the admixture; and causing the removal of the first and second labile blocking groups in situ to furnish said cross linking reagent to the reactive groups.

2. The batch process according to claim 1, further comprising causing the cure of said polymerisable binder to form a polymer bonded cast explosive composition.

3. The batch process according to claim 1, wherein forming the admixture includes selecting the cross-linking reagent comprising a polyisocyanate.

4. The batch process according to claim 3, wherein forming the admixture includes selecting the cross-linking reagent comprising a diisocyanate.

5. The batch process according to claim 3, wherein the first and second labile blocking groups are independently selected from (i) $NHR^2R^3$, wherein $R^2$ and $R^3$ are an alkyl, an alkenyl, a branched-chain alkyl, $C(O)R^{12}$, an aryl, a phenyl, or together form a heterocycle, wherein $R^{12}$ is an alkyl, an alkenyl, a branched chain alkyl, a branched chain aryl, a phenyl, or $R^2$ and $R^3$ together form a lactam;

(ii) $OR^{15}$, wherein $R^{15}$ is an aryl, a phenyl, or a benzyl having at least two nitro groups on the ring; or (iii) $O—N{=}CR^9R^{10}$, wherein $R^9$ and $R^{10}$ are independently selected from an alkyl, an alkenyl, a branched chain alkyl, an aryl, or a phenyl, and wherein at least one of $R^9$ or $R^{10}$ is a branched chain alkyl, a branched chain aryl, or a phenyl.

6. The batch process according to claim 5, wherein the first labile blocking group is the same as the second labile blocking group.

7. The batch process according to claim 1, wherein causing the removal of the first and second labile blocking groups includes heating the admixture.

8. The batch process according to claim 7, wherein heating the admixture is performed to a temperature not greater than 200° C.

9. The batch process according to claim 8, wherein the temperature is in the range of from 50° C. to 150° C.

10. The batch process according to claim 8, wherein the temperature is in the range of from 80° C. to 120° C.

11. The batch process according to claim 1, wherein forming the admixture includes selecting the polymerisable binder comprising a cellulosic material.

12. The batch process according to claim 1, wherein forming the admixture includes selecting the explosive material from RDX, HMX, FOX-7, TATND, HNS, TATB, NTO, HNIW, GUDN, picrite, aromatic nitramine, ethylene dinitramine, nitroglycerine, butane triol trinitrate, pentaerythritol tetranitrate, DNAN trinitrotoluene, inorganic oxidiser, ADN, ammonium perchlorate, energetic alkali metal salt, energetic alkaline earth metal salt, and combinations thereof.

13. The batch process according to claim 1, wherein at least one of the first and second labile blocking groups comprises a sterically hindered branched chain hydrocarbyl group.

14. The batch process according to claim 1, wherein causing the removal of the first and second labile blocking groups results in a polymer bonded explosive composition and one or more protonated blocking groups.

15. A batch process for filling a munition with a cross linked polymer bonded explosive composition, the batch process comprising:

forming an admixture of precure castable explosive composition, comprising an explosive material, a polymerisable binder, and a cross-linking reagent comprising a first reactive group protected by a first labile blocking group and a second reactive group protected by a second labile blocking group;

partially reacting the polymerisable binder with the cross-linking reagent to result in the admixture including partially polymerized binder-cross-linking reagent, wherein at least one of the first and second reactive groups of the cross linking reagent is protected by the respective first or second labile blocking group;

filling the munition with the admixture; and causing the removal of the unreacted first and second labile blocking groups in situ to furnish said cross linking reagent to the first and second reactive groups.

16. The batch process according to claim 15, wherein the first and second labile blocking groups are independently selected from (i) $NHR^2R^3$, wherein $R^2$ and $R^3$ are an alkyl, an alkenyl, a branched-chain alkyl, $C(O)R^{12}$, an aryl, a phenyl, or together form a heterocycle, wherein $R^{12}$ is an alkyl, an alkenyl, a branched chain alkyl, a branched chain aryl, a phenyl, or $R^2$ and $R^3$ together form a lactam;

(ii) $OR^{15}$, wherein $R^{15}$ is an aryl, a phenyl, or a benzyl having at least two nitro groups on the ring; or (iii) $O—N{=}CR^9R^{10}$, wherein $R^9$ and $R^{10}$ are independently selected from an alkyl, an alkenyl, a branched chain alkyl, an aryl, or a phenyl, and wherein at least one of $R^9$ or $R^{10}$ is a branched chain alkyl, a branched chain aryl, or a phenyl.

17. A batch process for filling a munition with a cross linked polymer bonded explosive composition, the batch process comprising:

forming an admixture of precure castable explosive composition, comprising an explosive material, a polymerisable binder, and a polyisocyanate having at least a first reactive group protected by a first labile blocking group B and a second reactive group protected by a second labile blocking group B;

filling the munition with the admixture; and causing the removal of the first and second labile blocking groups B in situ to furnish said polyisocyanate to the first and second reactive groups.

18. The batch process according to claim 17, wherein the first and second labile blocking groups B are independently selected from (i) $NHR^2R^3$, wherein $R^2$ and $R^3$ are an alkyl, an alkenyl, a branched-chain alkyl, $C(O)R^{12}$, an aryl, a phenyl, or together form a heterocycle, wherein $R^{12}$ is an alkyl, an alkenyl, a branched chain alkyl, a branched chain aryl, a phenyl, or $R^2$ and $R^3$ together form a lactam;

(ii) $OR^{15}$, wherein $R^{15}$ is an aryl, a phenyl, or a benzyl having at least two nitro groups on the ring; or (iii) $O—N{=}CR^9R^{10}$, wherein $R^9$ and $R^{10}$ are independently selected from an alkyl, an alkenyl, a branched chain alkyl, an aryl, or a phenyl, and wherein at least one of $R^9$ or $R^{10}$ is a branched chain alkyl, a branched chain aryl, or a phenyl.

19. The batch process according to claim 18, wherein forming the admixture includes selecting the explosive material from RDX, HMX, FOX-7, TATND, HNS, TATB, NTO, HNIW, GUDN, picrite, an aromatic nitramine, ethylene dinitramine, nitroglycerine, butane triol trinitrate, pentaerythritol tetranitrate, DNAN trinitrotoluene, an inorganic oxidiser, ADN, ammonium perchlorate, an energetic alkali metal salt, an energetic alkaline earth metal salt, and combinations thereof.

20. The batch process according to claim 18, wherein causing the removal of the unreacted first and second labile blocking groups includes heating the admixture in situ to a temperature in the range of from 50° C. to 150° C.

* * * * *